United States Patent [19]

McLennan

[11] 4,148,509

[45] Apr. 10, 1979

[54] HASP DOOR LATCH

[76] Inventor: Lyall A. McLennan, 2896 Trinity St., Vancouver, British Columbia, Canada, V5K 1E9

[21] Appl. No.: 774,748

[22] Filed: Mar. 7, 1977

[51] Int. Cl.[2] ..... E05C 19/08

[52] U.S. Cl. ..... 292/270; 292/202

[58] Field of Search ..... 292/262, 270, 268, 269, 292/285; 70/93

[56] References Cited

U.S. PATENT DOCUMENTS

| | | | |
|---|---|---|---|
| 473,785 | 4/1892 | Samuel | 292/268 |
| 622,556 | 4/1899 | Speirs | 292/270 |

FOREIGN PATENT DOCUMENTS

| | | | |
|---|---|---|---|
| 504474 | 4/1939 | United Kingdom | 292/268 |

*Primary Examiner*—Richard E. Moore

*Attorney, Agent, or Firm*—Robert W. Beach; Ward Brown

[57] ABSTRACT

The hinged strap of a hasp assembly is mounted on the inside surface of a door near its opening edge, which strap is swingable between a position in the path of the door to allow it to be opened a limited distance and a position retracted out of the door-opening path. The door can be maintained in limited opening position by engagement of the hasp strap with a pivotable bar of a keeper assembly attached to the door frame. With the strap in the door-opening position rotated out of the path of the door, the pivotable bar can be rotated from the position in which it engages the strap for allowing the door to be opened a limited amount to a position in the path of the door to block any opening movement.

10 Claims, 17 Drawing Figures

Fig. 1.
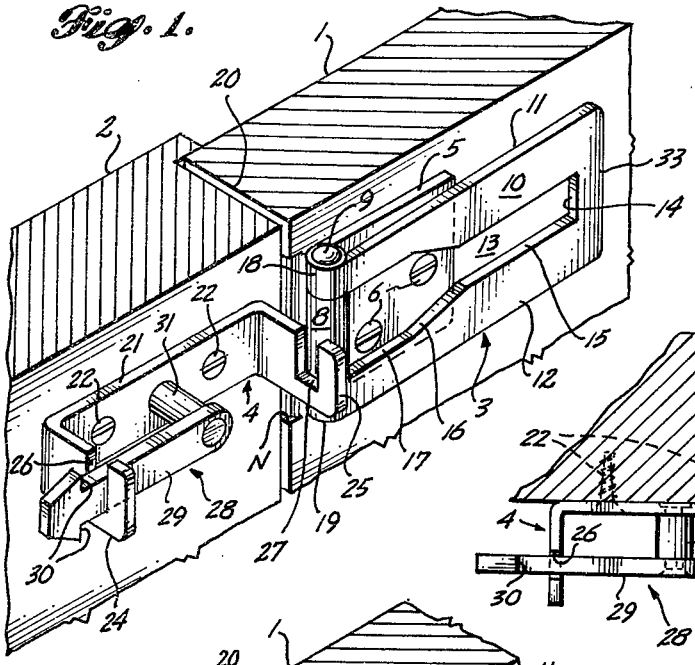
Fig. 2.
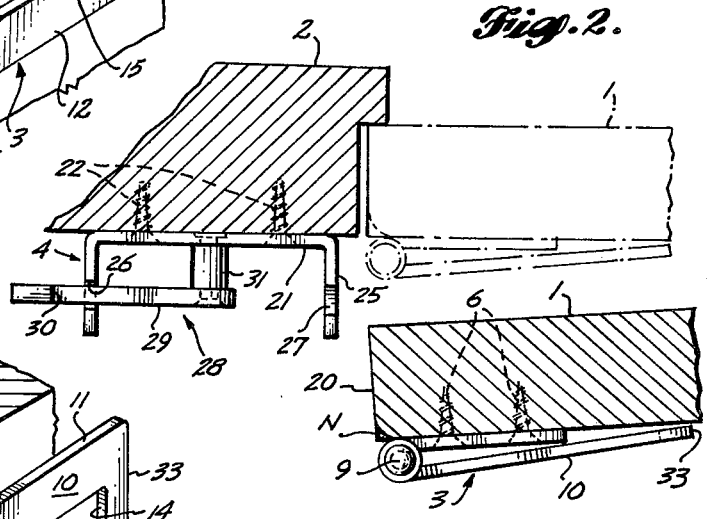
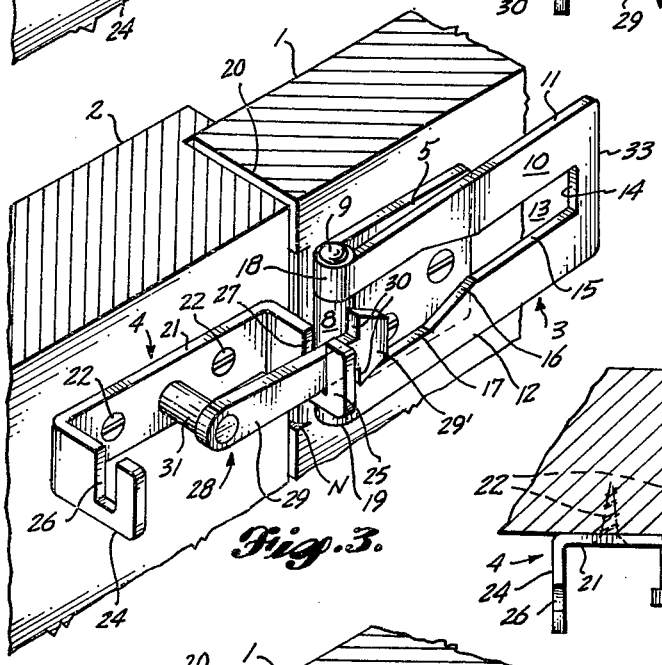
Fig. 3.
Fig. 4.
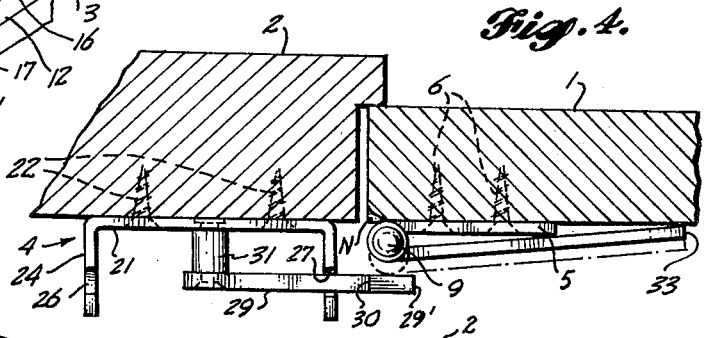
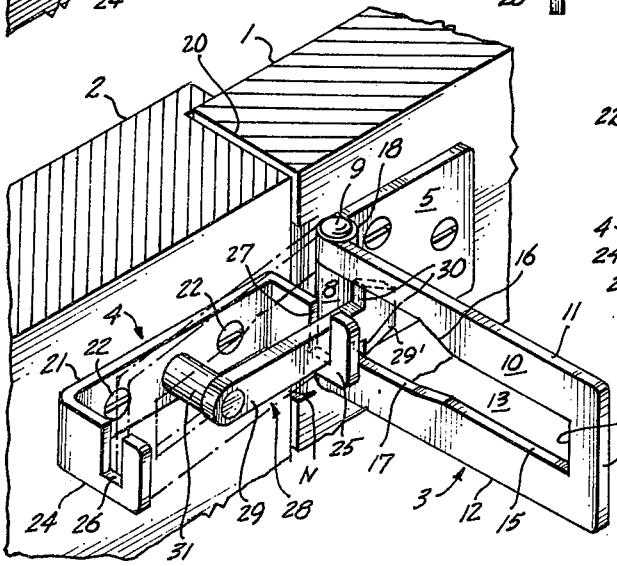
Fig. 5.
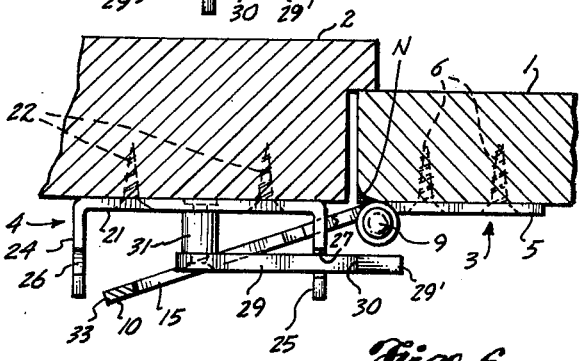
Fig. 6.

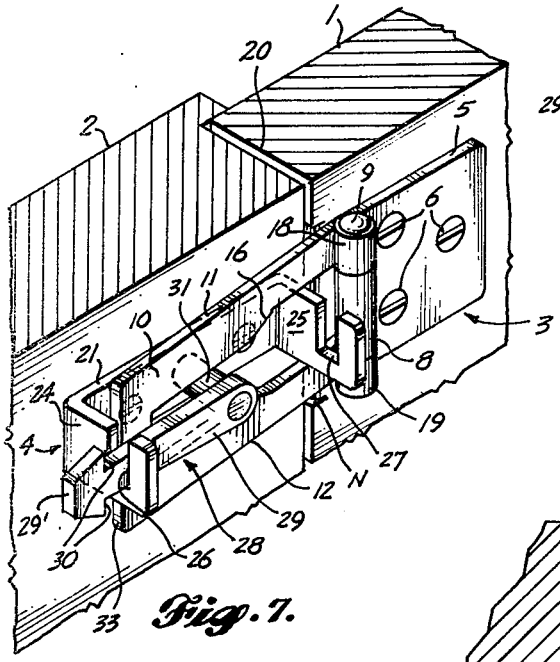
Fig. 7.
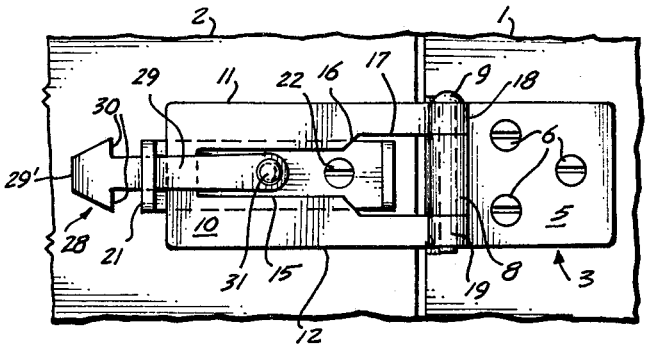
Fig. 8.
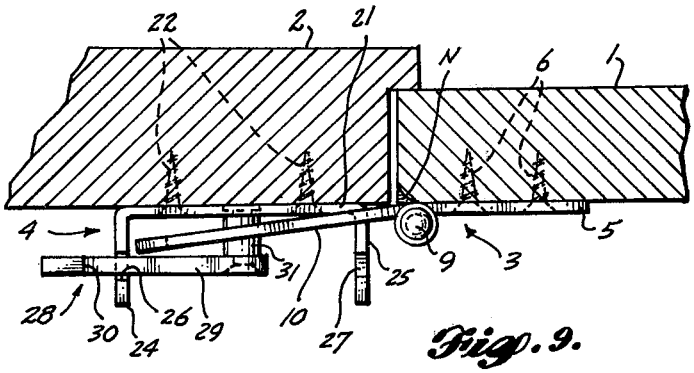
Fig. 9.
Fig. 10
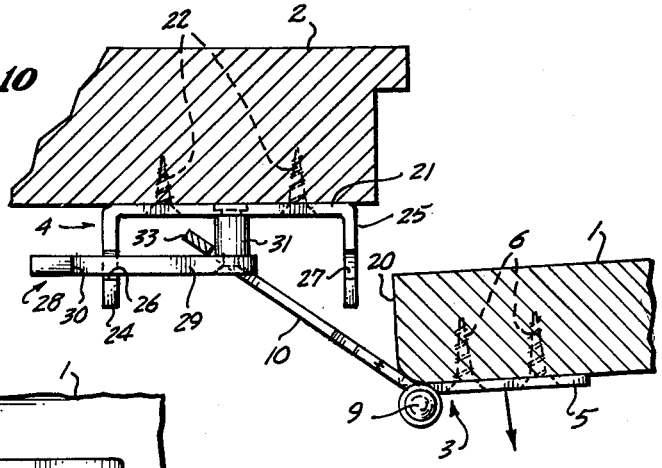
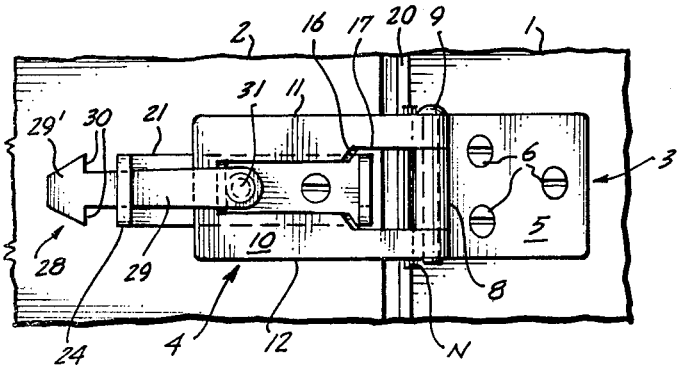
Fig. 11.

HASP DOOR LATCH

BACKGROUND OF THE INVENTION

1. Field of the Invention

The present invention relates to a latch for alternatively preventing the opening of a door or allowing the door to be opened only a limited distance.

2. Prior Art

Door latches to enable one on the inside of a building or living space to open a door a limited distance and converse with one standing outside the door while deterring the outsider from forcibly gaining access to the building or living space have been of the chain guard type. A chain has one end anchored to the doorjamb and the other end engageable with a keeper attached to the door. Because such latches are easily broken by forcing the door and because an outsider can easily reach through a doorway with a device such as a length of wire and disengage the chain from the keeper, or can simply cut the chain with a bolt cutter, the chain guard type of latch has provided limited security. To improve its utility, a key-operated tumbler lock has been incorporated in the keeper. This type of lock may provide increased security but always requires a key to engage or disengage the chain from the keeper.

To ensure against unauthorized entry, a lock only operable from the inside of a door, such as a sliding bolt type or hasp type, is often used in conjunction with a chain guard type lock. This multiplicity of locking devices results in increased costs and detracts from physical appearance. A sliding bolt lock has been incorporated in a chain guard lock in U.S. Pat. No. 3,788,107, but an additional key-operated tumbler lock is still required to ensure that the chain is not disengaged from the keeper by an outsider.

SUMMARY OF THE INVENTION

It is a principal object of the present invention to provide an efficient latch which takes up a minimum of space and which can be used alternatively to prevent opening of a door or to permit limited opening of a door without allowing a person on the outside of the door to forcibly gain entrance to the building or living space.

Other objects of the present invention are to provide a latch that is operable from only one side of a door, that is simple to operate and that does not require the use of a key.

Another object is to provide a latch construction which is simple, has few parts and is economical to manufacture, yet which is durable and cannot jam or otherwise readily become inoperative.

A further object is to provide a door latch which can be used with a door hinged either on its right or left side.

Still a further object is to provide such a door latch which can be installed easily and quickly by an unskilled person using common tools.

The foregoing objects can be accomplished by providing a hasp assembly securable to a door or doorjamb and a keeper assembly attached to the frame or door, respectively. A hinged strap of the hasp assembly is engageable with a pivotable bar of the keeper assembly in a relationship to permit opening the door a limited distance or, alternatively, in a relationship to prevent door-opening movement. The hinged strap and pivotable bar may be swung into disengaged, stored positions to permit unhindered door-opening movement.

BRIEF DESCRIPTION OF THE DRAWINGS

FIG. 1 is a top perspective of the hasp latch mechanism in door-opening position showing the hasp assembly mounted on the door and the keeper assembly mounted on the door frame; and FIG. 2 is a top plan thereof.

FIGS. 3 and 4 correspond to FIGS. 1 and 2, respectively, but show the hasp latch mechanism in door-blocking position.

FIG. 5 is a top perspective similar to FIG. 3 showing parts in different door-blocking relationship. FIG. 6 is a top plan showing parts in another door-blocking relationship.

FIG. 7 is a top perpsective of the latch mechanism illustrating the parts disposed in a relationship to permit limited opening of the door. FIG. 8 is a front elevation and FIG. 9 is a top plan thereof with the parts in the same position.

FIG. 10 is a top plan of the door shown in maximum open position with the latch mechanism in the limited opening relationship of FIG. 7; and FIG. 11 is the corresponding front elevation.

DETAILED DESCRIPTION

Figure 12:
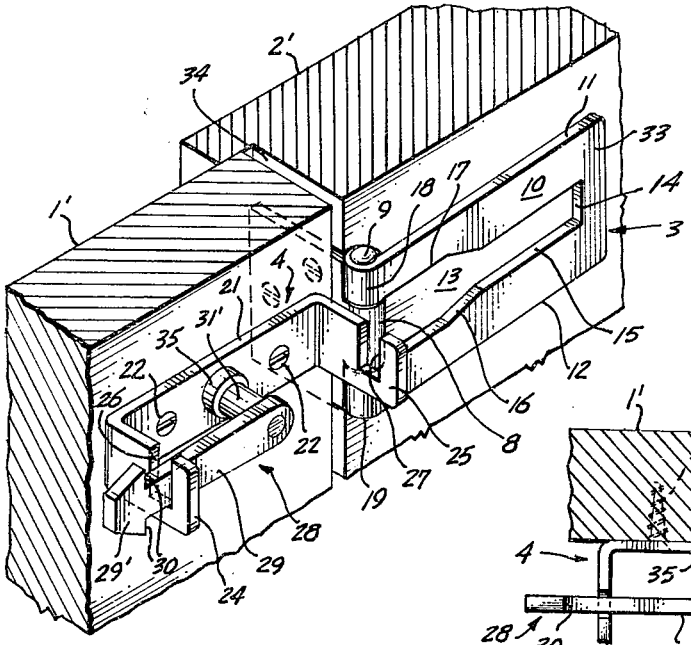
FIG. 12 is a top perspective of the latch mechanism in door-opening position with the parts mounted in a manner different from that shown in FIGS. 1 through 11, namely, the hasp assembly is mounted on the doorjamb and the keeper assembly is mounted on the door inside surface.

The hasp latch of the present invention serves the dual function of alternatively blocking opening or allowing limited opening of a swingable closure. The latch is particularly suitable for use with door 1 mounted in frame 2 to swing into a building or living space. The important feature is that the latch mechanism includes a hasp assembly 3 and a keeper assembly 4 selectively engageable with each other in blocking position to prevent appreciable opening movement of the closure, or in limited opening position to allow the closure to be opened a controlled distance, or disengageable from each other in unlatched position allowing free opening movement of the closure. The hasp assembly 3 can be attached to the inside surface of the door, as shown in FIGS. 1 through 11 inclusive, or to the door frame as shown in FIGS. 12 through 17.

In the first type of installation, as shown best in FIGS. 2, 4, 6, 9 and 10, hasp-mounting leaf 5 of the hasp assembly 3 is secured to the closure member shown as a door 1 by screws 6. A sleeve 8, preferably of cylindrical cross section, is tangentially connected to the margin of hasp-mounting leaf 5 located closest to and extending substantially parallel to the edge of door 1. Sleeve 8 projects from the side of mounting leaf 5 opposite the inside surface of door 1 to provide substantially continuous planar surface contact between the door and the mount for the hasp assembly 3 as shown best in FIGS. 2, 4 and 6. Such sleeve receives pintle 9 about which mounting hasp strap 10 is swingable, as described below.

Bifurcated hasp strap 10 has an upper branch 11 and a lower branch 12 in spaced coplanar relationship defining an elongated varying width, symmetrical slot 13 therebetween with its length extending transversely of or substantially perpendicular to the axis of pintle 9. Slot 13, as shown in FIGS. 1, 3 and 5, has a narrow portion 15 with a closed end 14 remote from pintle 9, a flared transition portion 16, and a wide portion 17 adjacent to pintle 9. Carried by the free end of branches 11 and 12, at opposite sides of wide slot portion 17, are sleeves 18 and 19, respectively. Such sleeves, preferably of cylindrical cross section, are spaced apart a distance slightly greater than the length of sleeve 8 of hasp mounting leaf 5 so as to straddle such sleeve in axial alignment with it. Thus, the upper sleeve 18 and lower sleeve 19, axially aligned with each other, can be aligned with sleeve 8 to receive pintle 9 therethrough, whereby hasp-mounting leaf 5 and hasp strap 10 are hingedly connected, as shown in FIGS. 8 and 11.

The pintle axis is parallel to the axis of rotation of door 1. Hasp strap 10 can be swung between the door-opening position of FIGS. 1 and 2, through the intermediate positions of FIGS. 5 and 6, to the limited opening position of FIGS. 7 to 11. It is preferable to provide a diagonal notch N in the edge 20 of door 1 adjacent to pintle 9, as shown best in FIGS. 2, 4, 6, 9 and 10. By providing such a notch, hasp assembly 3 can be mounted so that sleeves 8, 18 and 19 need not project beyond edge 20 of door 1 in order to enable hasp strap 10 to freely pivot through an angle greater than 180°, between opening and limited opening positions.

The mounting bracket of the keeper assembly 4 is of channel shape with its web 21 attached to the surface of door frame 2 by screws 22. The channel flanges 24 and 25 project outwardly from the door frame. The mounting bracket is disposed so that flanges 24 and 25 are aligned with slot 13, flange 25 being closer to hasp pintle 9 than is flange 24. Slots 26 and 27 in mounting bracket flanges 24 and 25, respectively, open upwardly and are horizontally aligned with each other to support pivoted retainer bar 28 in horizontal attitude alternatively in either of the two swung positions shown in FIGS. 1 and 3, respectively. Slots 26 and 27 are of a width to embrace substantially snugly retainer bar 28 and to prevent such bar from being bent outwardly from the surface of frame 2 when such bar is engaged with hasp assembly 3 to restrain movement of door 1 as shown in FIGS. 3 and 4.

Retainer bar 28 includes an elongated, flattened shank 29 on one end of which is a trapezoidal head 29' forming shoulders 30 projecting perpendicularly from opposite edges of shank 29. Head 29' could be of other conveniently manufactured geometric shapes, such as semicircular, or bar 28 could be cylindrical with the head of larger diameter than the shank. The important feature is that the vertical width of head 29' and the upright width of flange 25 must be less than the wide portion 17 of hasp slot 13 to allow such head and flange to pass therethrough when the strap is swung into the position in FIGS. 6 through 9, inclusive, while bar 28 is supported in slot 27 of flange 25.

The end of retainer bar 28 remote from head 29' is supported by pivot post 31 projecting from web 21 of the mounting bracket centrally between flanges 24 and 25. The axis of pivot post 31 extends perpendicular to the axis of pintle 9. Pivot post 31 also spaces bar 28 outwardly from the web 21 of the bracket to enable the bar to be received in either of slots 26 and 27.

In the manner described below, hasp strap 10 and retainer bar 28 can occupy three principal relative positions, namely unlatched opening position, latched limited opening position and latched blocking position. When the latch mechanism is in the unlatched position, hasp strap 10 is preferably swung away from the door frame 2 until its free end 33 touches door 1, as shown in FIGS. 1 and 2, to ensure that free end 33 does not strike against objects or persons located near the path of the door. Bar 28 is swung away from door 1 and held in horizontal position by slot 26 in remote flange 24 to prevent its interference with the opening of door 1.

The latch mechanism is shifted from the unlatched position to the blocking position of FIGS. 3 and 4 simply by swinging bar 28 out of remote flange slot 26 and into adjacent flange slot 27 so that head 29' blocks the path of door 1. As shown by the broken-line portion of FIG. 4, the head 29' of bar 28 extends beyond flange 25 a distance sufficient to be engaged by sleeve 8 of hasp mounting leaf 5 if an attempt is made to open door 1. Retainer bar 28 is solidly supported against movement transversely of its length by mounting bracket flange 25 loaded in tension and pivot post 31 loaded in compression by pressure of hasp sleeve 8 against the head 29'.

In order to prevent opening of the door beyond a limited slightly open position, for example to ascertain the identity of someone standing outside the door, the latch mechanism can be switched from unlatched position to limited opening latched position. While bar 28 is supported by adjacent flange 25, hasp 10 is swung from its position in contact with door 1 shown in FIGS. 1 through 4, through the position of FIG. 5 during which wide slot portion 17 passes over keeper bar head 29', further through the position of FIG. 6 during which wide slot portion 17 embraces adjacent keeper flange 25 and slot portions 15, 16 and 17 pass over the retainer bar shank 29, and finally into the position of FIG. 7 in which pivot post 31 is engaged in the narrow portion 15 of slot 13 and hasp strap 10 is disposed between the web 21 of the mounting bracket and the shank 29 of keeper or retainer bar 28. Such bar is then swung from the slot 27 of adjacent mounting bracket flange 25 to the slot 26 of remote mounting bracket flange 24 as shown in FIGS. 7 to 9 to retain post 31 engaged in the hasp strap slot 13. Door 1 can now be opened through a limited small distance as shown in FIG. 10, by relative sliding of cooperating slotted hasp strap 10 and slot-engaged keeper post 31. Further opening movement of the door is checked by the end 14 of hasp strap slot 13 engaging pivot post 31 and the shank 29 of bar 28.

With the latch mechanism in the limited opening position of FIGS. 7 to 9 when the door is closed, remote flange 24 is spaced from pintle 9 a greater distance than the length of hasp strap 10. As shown in FIG. 8, adjacent flange 25 is spaced from pintle 9 a distance less than the length of the wide slot portion 17 so that such slot portion is in registration with flange 25 with such flange extending through such slot portion. Furthermore, the distance between slot end 14 and pivot post 31 when hasp strap 10 is in the limited opening position determines the distance the door can be opened. Such distance between slot end 14 and pivot post 31 is selected to insure that the door can be opened an adequate distance to enable one inside the door to observe and converse with someone outside the door, but still not allow the outsider to reach through the door opening.

Because hasp slot 13 straddles retainer bar 28 when the door is in partially opened position as shown in FIG. 10, such bar cannot be swung up out of the slot in flange 24, as can be seen in FIGS. 10 and 11. Consequently, if the door is left unattended in the limited open position, for example for ventilation, the latch cannot be released because the door must be closed sufficiently to place hasp strap 10 between slot 27 and mounting bracket web 21 in order to free bar 28 to swing out of slot 26 and into slot 27, as shown in FIG. 9. Therefore, there is no way to release the latch from the outside of the door.

If it is desired to unlatch the door 1 after having opened it a limited distance to admit a person standing outside the door, door 1 is first closed enough to allow hasp strap 10 to be positioned inwardly of mounting bracket flange slot 27 so that bar 28 can be swung from remote slot 26 into adjacent slot 27. Hasp strap 10 is then simply swung away from door frame 2 until strap end 33 contacts the surface of door 1, as shown in FIGS. 1 and 2. Bar 28 is swung back into slot 26 of remote flange 24 to allow door 1 to be opened.

FIGS. 1 through 11 inclusive show the hasp latch mounted on a door hinged on its right side. The hasp latch is equally suitable to be used in conjunction with a door hinged on its left side. Keeper assembly 4 is symmetrical about a central plane so that it can be attached to the door frame at the right side of the door and hasp assembly 3 is symmetrical about a horizontal plane so that it can be mounted on the right margin of the door after it has been inverted from the illustrated positions.

Figure 13:
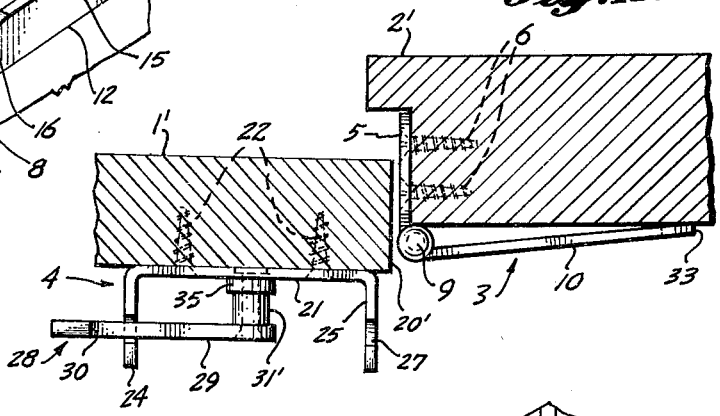
FIG. 13 is the corresponding top plan with the door in partially opened position.
Figure 15:
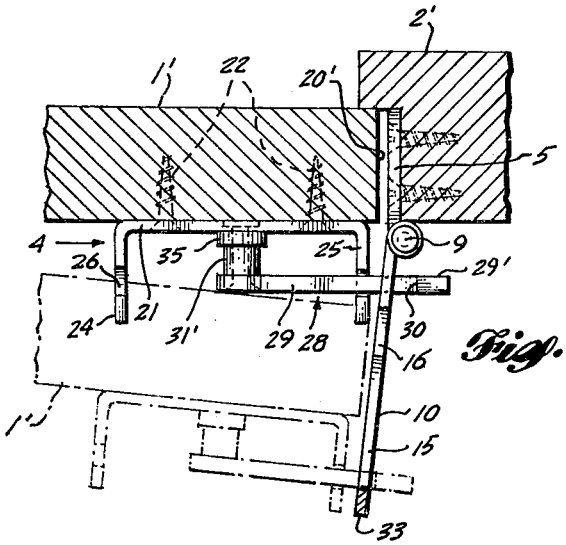
FIG. 15 is a top plan of the latch mechanism in condition to permit limited opening of the door, the door being shown in closed position in solid lines and in maximum open position in dot-dash lines.
Figure 16:
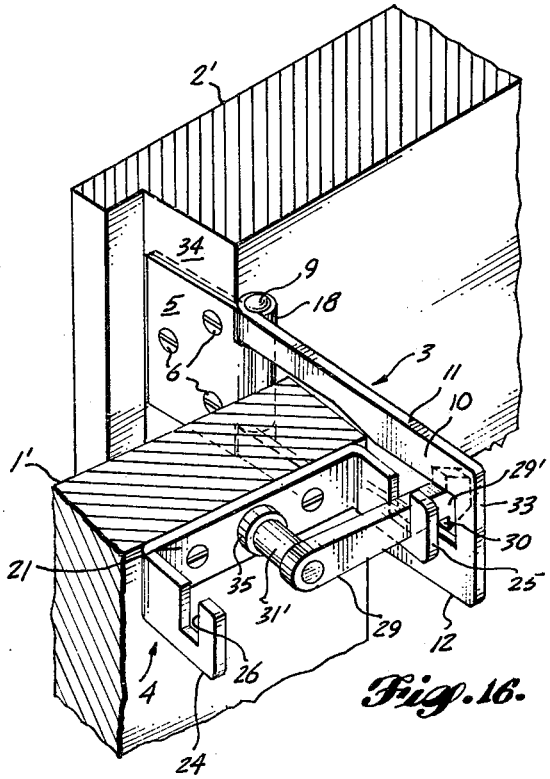
FIG. 16 is a top perspective corresponding to the dotdash position shown in FIG. 15.

As an alternative type of installation, rather than attach hasp assembly 3 to door 1 and keeper assembly 4 to door frame 2, as previously described and illustrated in FIGS. 1 through 11, inclusive, their mounting locations can be reversed, as shown in FIGS. 12 through 17, inclusive. In this reversed mounting arrangement, mounting leaf 5 of hasp assembly 3 can be attached to the jamb 34 of frame 2' by screws 6. Preferably such mounting plate portion is recessed so as to be substantially flush with the jamb, as shown in FIG. 16. If desired, the hasp mounting leaf 5 can be mounted on the inside face of door frame 2' so that the mounting leaf and strap 10 would be in substantially parallel relationship in unlatched condition. With the hasp assembly 3 installed on jamb 34, as shown in FIGS. 12 and 13, mounting leaf 5 and strap 10 are disposed substantially perpendicular in unlatched condition.

As before, the axis of pintle 9 is parallel to the hinges (not shown) of the door. The hasp mounting leaf 5 is positioned on the door jamb so that sleeve 8 is offset to the side of mounting leaf 5 away from the door to minimize the required clearance between door edge 20' and jamb 34.

The keeper assembly 4 can be attached to the door, as shown in FIGS. 12 through 16, inclusive, by securing the web 21 of the mounting bracket to the inside surface of door 1' by screws 22.

Figure 14:
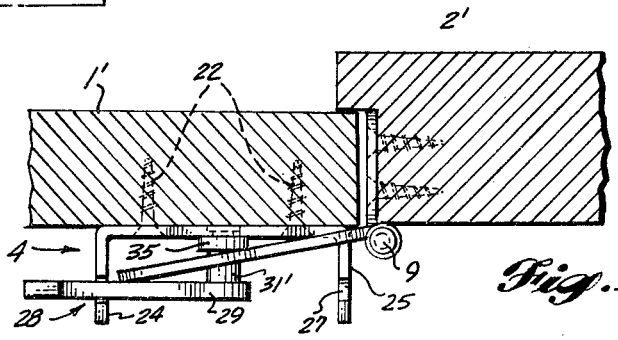
FIG. 14 is a top plan of the latch mechanism of FIG. 12 in door-blocking position.

Pivot post 31' of keeper assembly 4 is shown as having a concentric collar or boss forming a shoulder 35 on the end of the pivot post 31' fixedly attached to the web 21 of the mounting bracket. Shoulder 35 reacts against hasp strap 10 when strap 10 is trapped between the mounting bracket web and retainer bar 28, as shown in FIG. 14, to prevent door 1' from being opened. Shoulder 35 spaces strap 10 from the surface of door 1' so that such surface is prevented from being marred.

When the latch mechanism is in the unlatched position of FIGS. 12 and 13, it is preferred that bar 28 be engaged in slot 26 of mounting bracket flange 24 remote from pintle 9 and for hasp strap 10 to be swung toward the door frame 2' as far as possible. In these positions, both bar 28 and hasp strap 10 will not interfere with persons passing through the doorway.

To prevent the door from being opened, retainer bar 28 is swung to engage in the slot 27 of mounting bracket flange 25 closer to pintle 9. Hasp strap 10 is then swung toward door 1' through the position of FIG. 15 to the position of FIG. 14, its slot 13 passing over bar 28, until it contacts shoulder 35. Bar 28 is then swung back to engage in the slot 26 of remote mounting bracket flange 24 as shown in FIG. 14. With the hasp latch in such blocking position, mounting bracket flange 25 extends through wide portion 17 and pivot post 31' extends through narrow portion 15 of slot 13 in hasp strap 10 in which relationship the parts are shown in FIG. 8.

If it is desirable to open door 1' a limited distance to enable one on the inside of door 1', for example, to speak to someone on the outside, retainer bar 28 need only be swung to be received in slot 27 of the adjacent flange 25 and hasp strap 10 swung from either unlatched position (FIG. 12) or door-blocking latched position (FIG. 14) to a location between adjacent flange 25 and latch bar shoulder 30, as illustrated in FIGS. 15 and 16. Door 1' can then be opened only the distance shown by the broken-line portion of FIG. 15 in which position latch bar shank 29 contacts slot end 14. Hasp strap 10 is prevented from sliding outwardly beyond the free end of bar 28 because the combined width of shank 29 and the lateral projection of one shoulder 30 is greater than the width of the narrow portion 15 of slot 13.

Furthermore the difference between the length of slot 13 and the sum of the door thickness plus the length of pivot post 31' when hasp strap 10 and bar 28 are in the limited opening position shown in FIG. 16 and in broken lines in FIG. 15 determines the maximum width of opening between the door and the door jamb. The length of slot 13 and pivot post 31 is selected to insure that the door can be opened an adequate distance to enable one on the inside of the door to observe and converse with someone on the outside of the door, but still not allow the outsider to reach through the door opening. Moreover, if the door is left unattended in the limited opening position, for example for ventilation, it is impossible to release the latch from the outside because the length of wide slot portion 17 is less than the door thickness. Therefore, the door must be closed before hasp strap 10 can be swung to pass the wide slot portion 17 over head 29' of retainer bar 28.

Door 1 can be fully opened from the limited-opening position of FIGS. 15 and 16 by first closing the door and then swinging the hasp strap 10 toward door frame 2' until it disengages bar 28. Preferably, bar 28 is also swung from slot 27 of mounting bracket flange 25 to slot 26 of mounting bracket flange 24. The path of door 1' is now unblocked as shown in FIGS. 12 and 13, enabling it to be fully opened.

Figure 17:
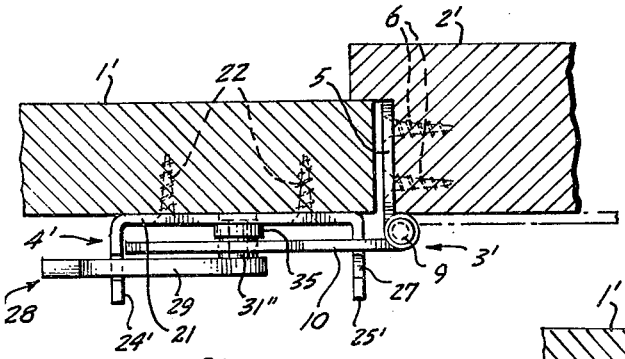
FIG. 17 is a plan of a modified form of the latch mechanism of FIGS. 12 and 13, shown in door-blocking position in solid lines and door-opening position in dot-dash lines.

In the alternative construction shown in FIG. 17, hasp assembly 3' is assembled with hasp strap 10 flipped 180° about its axis of symmetry relative to mounting leaf 5 from the arrangement of hasp strap 10 shown in FIGS. 12 through 16 inclusive. This particular hasp assembly construction enables the full length of strap 10 to lie flat against the inner surface of wall 2' when the mounting leaf 5 is secured to the jamb by screws 6 as described in connection with FIGS. 12 to 16 and strap 10 is in the unlatched position, as illustrated by the broken-line portion of FIG. 17. Because hasp strap 10 is now offset to the side of the pintle axis adjacent to the surface of the door frame 2', the hasp strap can be disposed parallel to both web 21 of the keeper mounting channel bracket and bar 28 when in the closure-blocking position, thus allowing pivot post 31'' to be shorter than pivot post 31' shown in FIGS. 12 through 16 inclusive. Correspondingly, flanges 24' and 25' can be narrower, thus reducing the extent of their outward projection from the inside surface of door 1'.

The latch arrangement of FIG. 17 can be set for enabling the door to be opened fully by swinging the retainer bar 28 and the hasp strap 10 in the manner discussed in connection with FIGS. 12 to 16. Alternatively the latch arrangement can be set to enable the door to be opened to a limited extent by placing the retainer bar 28 and strap 10 in positions such as shown in FIGS. 15 and 16.

I claim:

1. Latch mechanism for a closure member openable relative to a frame member comprising a hasp strap having an elongated slot therein, means for mounting said hasp strap on one of the members for swinging of said hasp strap about an axis generally perpendicular to the length of said hasp strap slot, said hasp strap slot having a closed end remote from said axis, and keeper means mounted on the other member and slidingly engageable with said hasp strap slot to enable the closure member to move relative to the frame member between closed position of the closure member and a predetermined limited slightly open position, said keeper means including bar means engageable with said slot when the door is in limited slightly open position, pivot means pivotally mounting said bar means for swinging about a substantially horizontal axis and bar support means for supporting said bar means substantially horizontally and engaged with the closed end of said hasp strap slot for restraining the closure member in limited slightly open position.

2. The latch mechanism defined in claim 1, the bar support means including a flange located between the pivot means and the hasp strap axis, said flange including open-ended slot means for receiving the bar means.

3. The latch mechanism defined in claim 1, the bar support means including flanges located at opposite sides of the pivot means, each of said flanges including open-ended slot means for receiving the bar means.

4. Latch mechanism for a closure member openable relative to a frame member comprising a hasp strap having an elongated slot therein, means for mounting said hasp strap on one of the members for swinging of said hasp strap about an axis generally perpendicular to the length of said hasp strap slot, said hasp strap slot having a closed end remote from said axis, and keeper means mounted on the other member and slidingly engageable with said hasp strap slot to enable the closure member to move relative to the frame member between closed position of the closure member and a predetermined limited slightly open position, said keeper means including bar means engageable with said slot when the door is in limited slightly open position, pivot means pivotally mounting said bar means for swinging and bar support means for opposing deflection of said bar means by force of said hasp strap thereon.

5. The latch mechanism defined in claim 4, the bar support means including flanges located at opposite sides of the pivot means with open-ended slot means for receiving the bar means in oppositely-swung positions.

6. Latch mechanism for a closure member openable relative to a frame member comprising a hasp strap having an elongated slot therein, means for mounting said hasp strap on one of the members for swinging of said hasp strap about an axis generally perpendicular to the length of said hasp strap slot, said hasp strap slot having a closed end remote from said axis, and keeper means mounted on the other member, said keeper means including pivot means having an axis extending substantially perpendicular to said hasp strap slot and including pivot post means slidingly engageable with said hasp strap slot to enable the closure member to move relative to the frame member between closed position of the closure member and a predetermined limited slightly open position, and bar means pivotally carried by said pivot means for swinging to block disengagement of said pivot post means from said hasp strap slot.

7. Latch mechanism for a closure member openable relative to a frame member comprising a hasp strap having an elongated slot therein, means for mounting said hasp strap on one of the members for swinging of said hasp strap about an axis generally perpendicular to the length of said hasp strap slot, said hasp strap slot having a closed end remote from said axis, and keeper means mounted on the other member and slidingly engageable with said hasp strap slot to enable the closure member to move relative to the frame member between closed position of the closure member and a predetermined limited slightly open position, said keeper means including bar means engageable with said slot when the door is in limited slightly open position and pivot means pivotally mounting said bar means for swinging, said bar means including a rectangular shaped elongated shank pivotally connected at one end to said pivot means and extendable through said hasp strap slot and a head on the other end of said shank having shoulders extending generally perpendicularly from said shank a distance greater than the width of a portion of said slot to block disengagement of said shank from said slot portion.

8. The latch mechanism defined in claim 7, the hasp strap slot including a wide portion of a width to enable passage of the bar head therethrough, and a narrow portion of a width insufficient for passage of the bar head therethrough but sufficient to enable the bar shank to pass therethrough.

9. Latch mechanism for a closure member openable relative to a frame member comprising a hasp strap having an elongated slot therein, means for mounting said hasp strap on one of the members for swinging of said hasp strap about an axis generally perpendicular to the length of said hasp strap slot, said hasp strap slot having a closed end remote from said axis, and keeper means mounted on the other member, said keeper means including bar means, pivot means pivotally mounting said bar means for swinging about a substantially horizontal axis to block opening movement of the closure member and bar support means for supporting said bar means in the path of closure member opening movement.

10. In a hasp latch mechanism for a closure member openable relative to a frame member including hasp means on one of such members adjacent to the other member and keeper means mounted on the other member and cooperable with the hasp means, the improvement comprising the hasp means and the keeper means including a first cooperating element having a slot therein, a second cooperating element slidingly engageable with said slot to enable the closure member to move relative to the frame member between closed position of the closure member and a predetermined limited slightly open position, bar means, a pivot carrying said bar means for swinging so that it is movable to a position for retaining the second cooperating element engaged with said slot, and bar support flanges located on opposite sides of said pivot and having open-ended slot means for receiving said bar means in oppositely-swung positions.

* * * * *

UNITED STATES PATENT AND TRADEMARK OFFICE

CERTIFICATE OF CORRECTION

PATENT NO. : 4,148,509

DATED : April 10, 1979

INVENTOR(S) : Lyall A. McLennan

It is certified that error appears in the above-identified patent and that said Letters Patent are hereby corrected as shown below:

Column 7, line 39, cancel "door" and insert --closure member--; line 67, cancel "door" and insert --closure member--.

Column 8, line 39, cancel "door" and insert --closure member--.

Signed and Sealed this

*Twenty-fifth* Day of *December 1979*

[SEAL]

*Attest:*

SIDNEY A. DIAMOND

*Attesting Officer*

*Commissioner of Patents and Trademarks*